US009643326B2

(12) United States Patent
Ortins et al.

(10) Patent No.: US 9,643,326 B2
(45) **Date of Patent: *May 9, 2017**

(54) SHAVING RAZOR DEMONSTRATION APPARATUS AND METHOD

(71) Applicant: The Gillette Company, Boston, MA (US)

(72) Inventors: Marc Philip Ortins, Reading, MA (US); Carmen Gallo, Lynn, MA (US); Eric Viveros Borges, Plymouth, MA (US)

(73) Assignee: The Gillette Company, Boston, MA (US)

( * ) Notice: Subject to any disclaimer, the term of this patent is extended or adjusted under 35 U.S.C. 154(b) by 419 days.

This patent is subject to a terminal disclaimer.

(21) Appl. No.: 14/097,767

(22) Filed: Dec. 5, 2013

(65) Prior Publication Data

US 2014/0352154 A1 Dec. 4, 2014

Related U.S. Application Data

(60) Provisional application No. 61/830,299, filed on Jun. 3, 2013.

(51) Int. Cl.
*B26B 21/14* (2006.01)
*B26B 21/40* (2006.01)

(52) U.S. Cl.
CPC ..... *B26B 21/14* (2013.01); *B26B 21/4093* (2013.01)

(58) Field of Classification Search
CPC ..... B26B 21/4093
USPC ..... 434/365, 367, 377
See application file for complete search history.

(56) References Cited

PUBLICATIONS

"PR2 Robot Helps Quadriplegic Man Shave Himself," Hornyak, CNET Magazine, http://www.cnet.com/news/pr2-robot-helps-quadriplegic-man-shave-himself/, which includes a video clip, https://www.youtube.com/watch?v=DqrrxPwBcU4 &feature=player_embedded, Jul. 14, 2011.*
"Panasonic ES-RT51-S 3 Blade Electric Razor Wet/Dry with Flexible Pivoting Head for Men," Panasonic, http://www.amazon.com/Panasonic-ES-RT51-S-Electric-Flexible-Pivoting/dp/B0043DMNHS, Nov. 30, 2010.*
"Razor Edge Durability and Sharpness Tester," CATRA, https://www.youtube.com/watch?v=rNLLjkVwp7E, Oct. 4, 2007.*

* cited by examiner

*Primary Examiner* — Nikolai A Gishnock
*Assistant Examiner* — Jennifer L Korb
(74) *Attorney, Agent, or Firm* — Ronald T. Sia; Kevin C. Johnson; Steven W. Miller

(57) ABSTRACT

A shaving demonstration apparatus having a rotatable support surface. A drive unit is operatively connected to the rotatable support surface. A fixture is spaced apart from the rotatable support surface. A first shaving razor has a first handle having a central longitudinal axis, said handle mounted to the fixture. A first blade cartridge unit is mounted to an end of the first handle, and rotates about a torsional rotation axis with respect to said handle, wherein the central longitudinal axis and the torsional rotational axis are generally parallel. The first blade cartridge unit contacts the rotatable support surface.

11 Claims, 14 Drawing Sheets

SHAVING RAZOR DEMONSTRATION APPARATUS AND METHOD

BACKGROUND OF THE INVENTION

Consumers of disposable and system shaving razors (i.e., razor handles having a replaceable razor cartridge) continue to demand improved product performance. As a result, razor manufacturers continually try to improve upon various shaving razor performance attributes that are desired by consumers. However, even when a better shaving razor is designed and manufactured, razor manufacturing companies, advertisers and retailers face difficulty in communicating to the consumers, especially in a meaningful, clear and visual manner, that a particular shaving razor product demonstrates improved or more effective performance, for example closeness, fewer missed hairs or comfort, compared to other shaving razor products.

Accordingly, there is a need for an apparatus and/or a method for demonstrating to consumers particular advantages of using certain shaving razors. There is also a need for a method to demonstrate performance differences between shaving razors such as fixed, single pivot and/or multiple pivot razors, and to clearly communicate these differences to consumers.

SUMMARY OF THE INVENTION

In one aspect, the invention features, in general, a simple, efficient shaving demonstration apparatus for communicating to a consumer, particular advantages of using a certain shaving razor. The shaving demonstration apparatus has a rotatable support surface and a drive unit operatively connected to the rotatable support surface. A fixture is spaced apart from the rotatable support surface. A first shaving razor having a first handle is mounted to the fixture. A first blade cartridge unit is mounted to an end of the first handle. The first blade cartridge unit contacts the rotatable support surface. The first shaving razor has a handle comprising a grip portion and a connection portion which attaches to a blade cartridge unit. The handle has a central longitudinal axis which extends the general length of the elongated handle. The blade cartridge unit is rotatable around a torsional rotation axis which is generally parallel to said central longitudinal axis, or within 30 degrees, preferably within 15 degrees, preferably within 5 degrees, or even parallel. When the first blade cartridge unit contacts the rotatable support surface, the blade cartridge unit can go from an at rest position to a first biased position which rotates the blade cartridge unit clockwise or counterclockwise along the torsional rotation axis.

If, desired, particular embodiments may optionally include the rotatable support surface comprising a drum. Particular embodiments may also optionally include the drum having a first cross section of a first ellipse. Particular embodiments may also optionally the drum having a second cross section of a second ellipse that is offset from the first ellipse.

In one aspect, the invention features, in general, a simple, efficient shaving demonstration method for communicating to a consumer, particular advantages of using a certain shaving razor. The shaving demonstration method has a step of providing a rotatable support surface. A handle having a blade cartridge unit is mounted to a fixture. The blade cartridge unit is brought into contact with the rotatable support surface. The rotatable support surface is rotated causing the blade cartridge unit to rotate about at least one axis relative to the handle.

If, desired, particular embodiments may optionally include applying a lubricant to the rotatable support surface. Particular embodiments may also optionally include providing the fixture with a platform having a linear slide and rotating the rotatable support surface causes the handle and the linear slide to move relative to the platform.

The details of one or more embodiments of the invention are set forth in the accompanying drawings and the description below. It is understood that certain embodiments may combine elements or components of the invention, which are disclosed in general, but not expressly exemplified or claimed in combination, unless otherwise stated herein. Other features and advantages of the invention will be apparent from the description and drawings, and from the claims.

DETAILED DESCRIPTION OF THE DRAWINGS

FIG. 5 is a cross section view of the drum, taken generally along the line 6-6 of FIG. 4.

Figure 11:
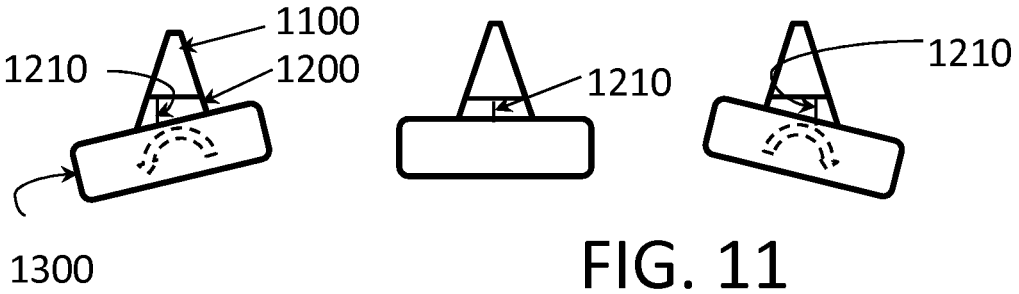
FIG. 11 is a frontal perspective view of a razor suitable for use with the present invention in three different orientations.
Figure 12:
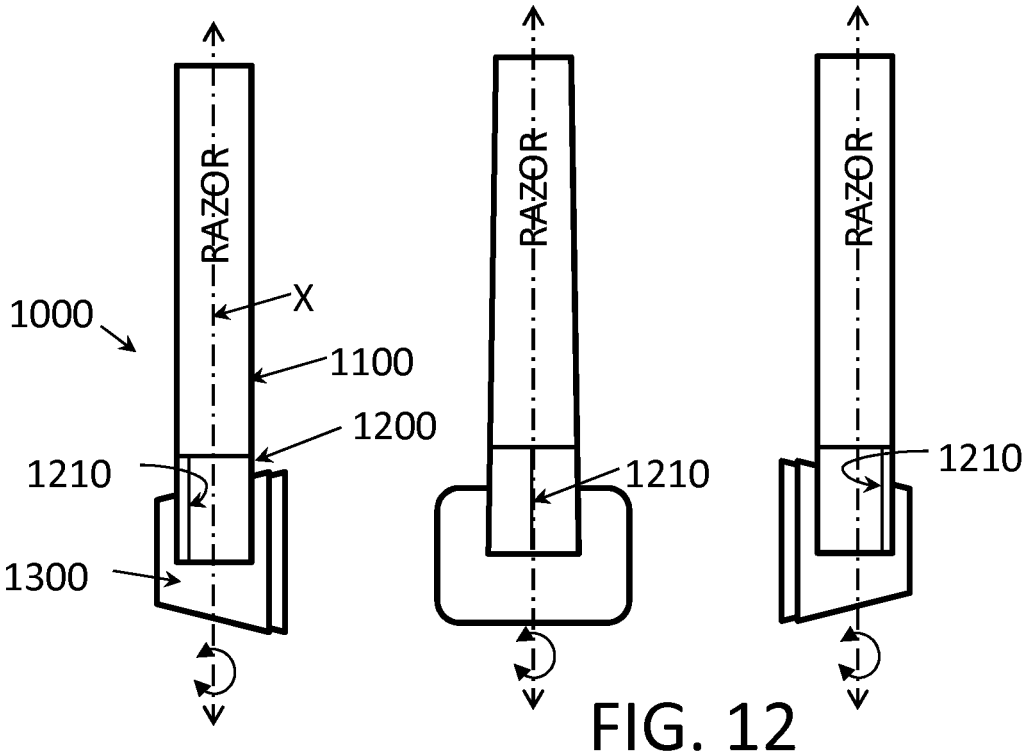
FIG. 12 is a top view of a razor suitable for use with the present invention, also in three different orientations.
Figure 13:
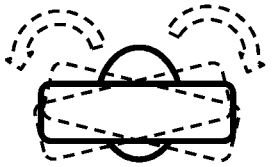
FIG. 13 is a frontal planar view of a razor having a cartridge head that rotates about a central axis parallel to the central longitudinal axis of the device.
Figure 14A:
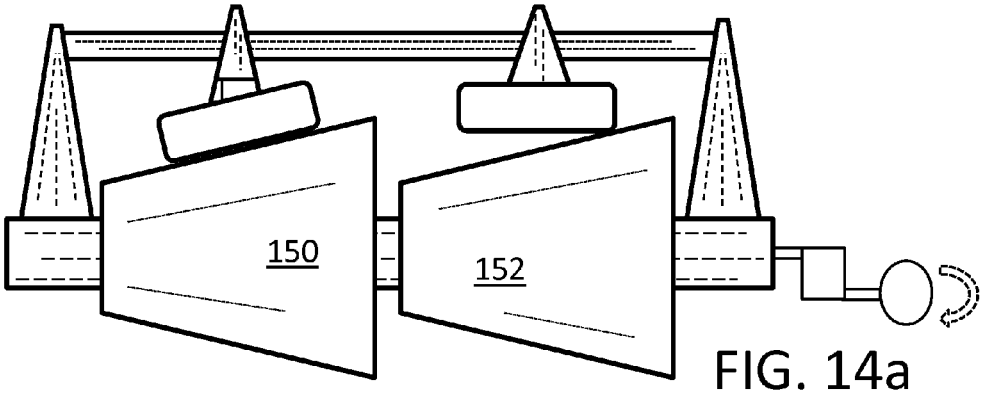
Figure 14B:
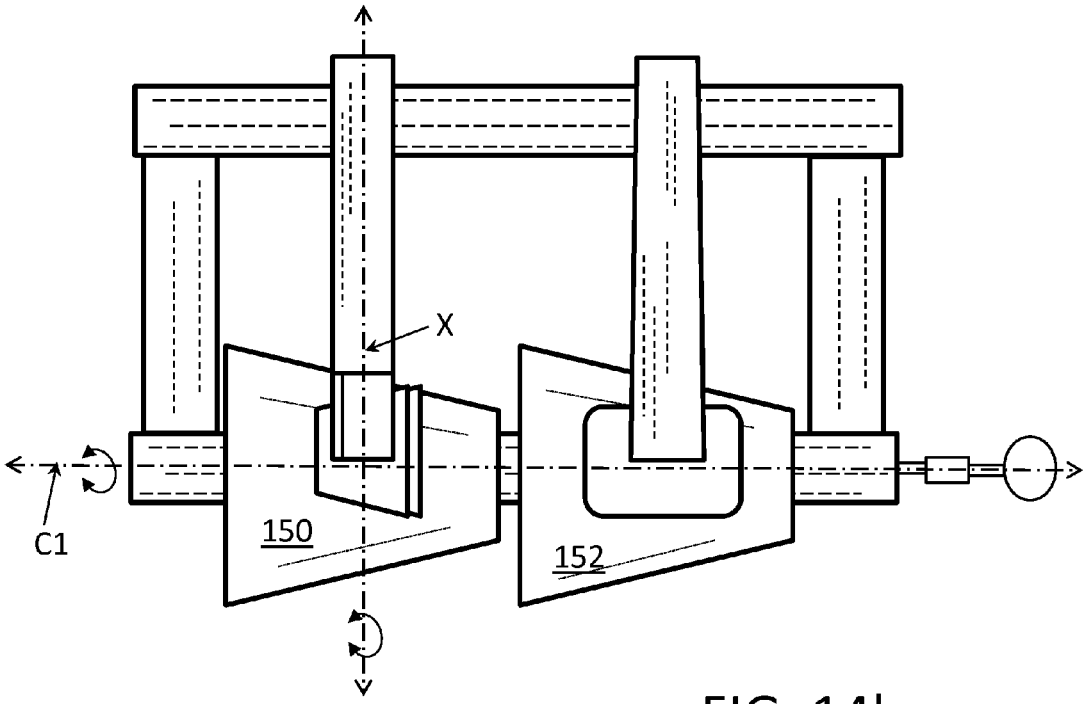

FIGS. 14*a* and 14*b* perspective view of one possible embodiment of a shaving demonstration apparatus with the shaving razor shown in FIGS. 11-13, and a standard razor that does not include a torsional rotational axis.

Figure 15A:
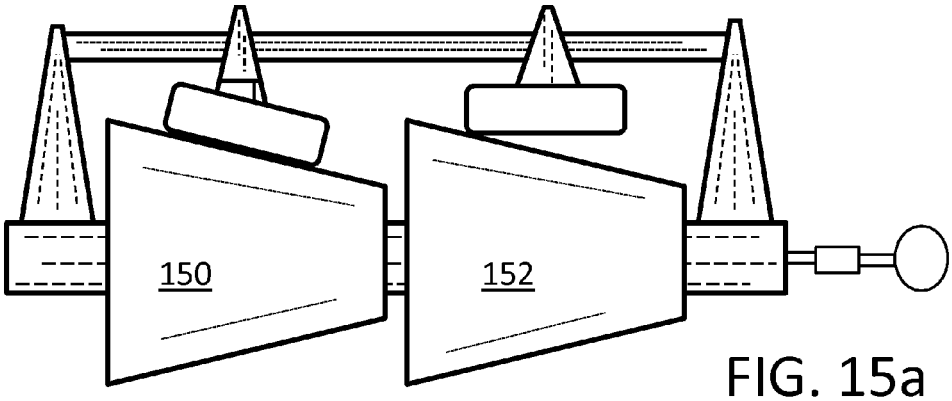
Figure 15B:
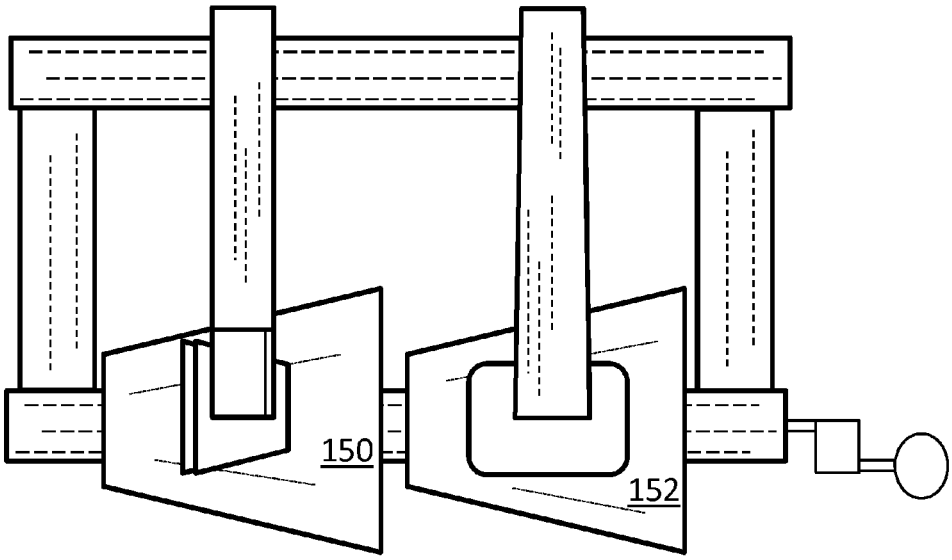

FIGS. 15*a* and 15*b* perspective view of one possible embodiment of a shaving demonstration apparatus with the shaving razor shown in FIGS. 11-13, and a standard razor that does not include a torsional rotational axis.

Figure 1:
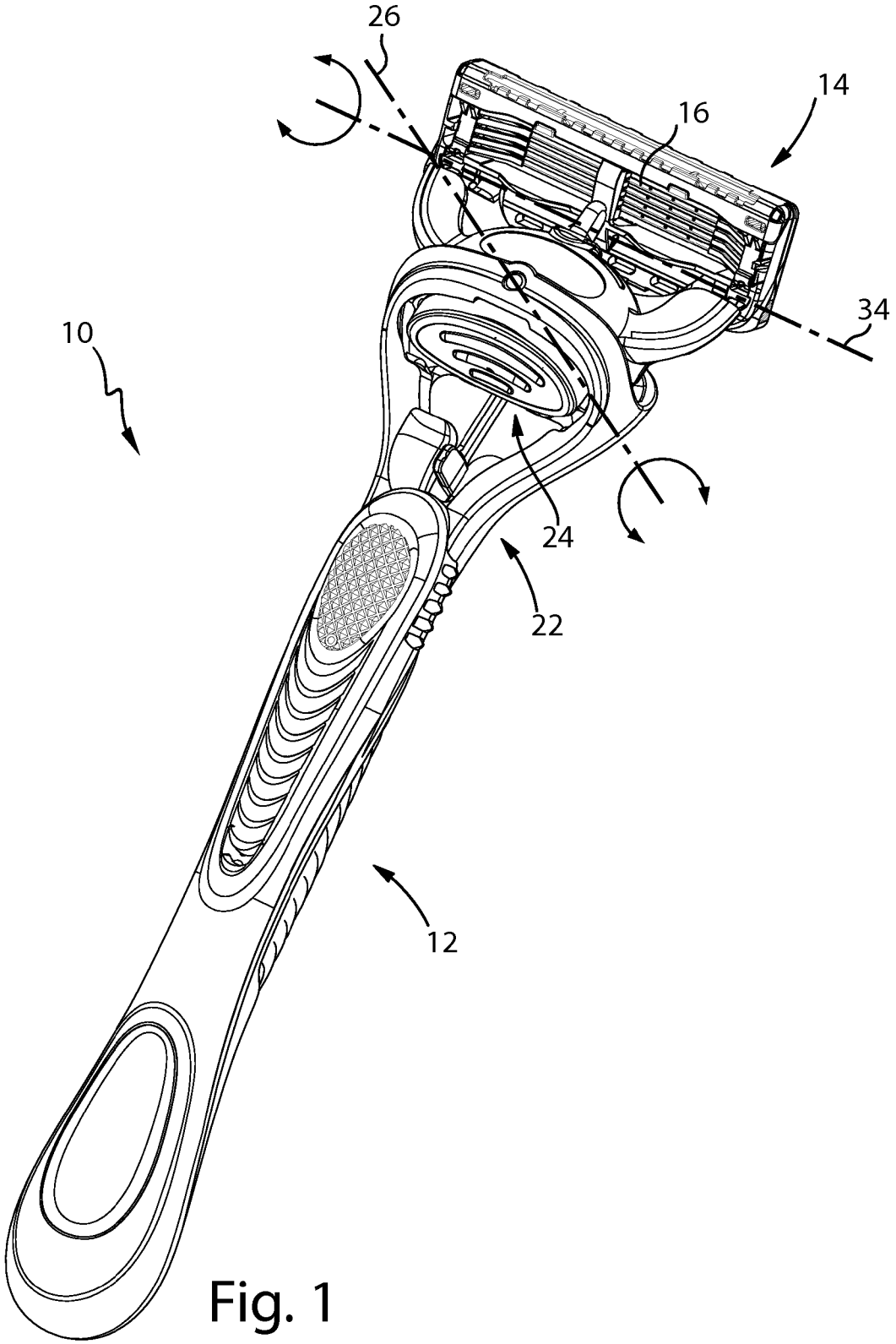
FIG. 1 is a perspective view of a shaving razor with a blade cartridge unit that rotates about more than one axis of rotation.
Figure 16:
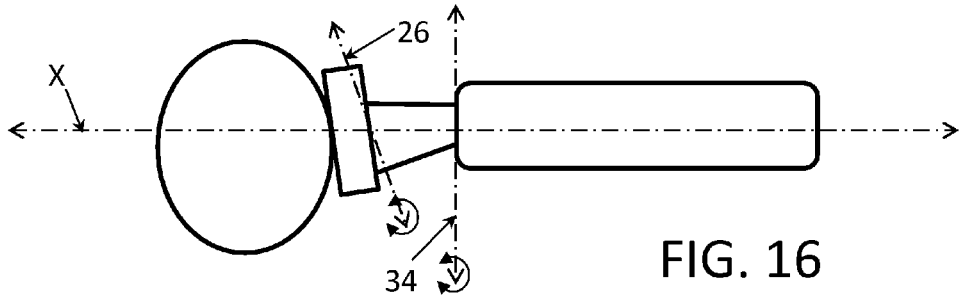

FIG. 16 is a simplified side view of a razor similar to that shown in FIG. 1, in contact with a rotatable support surface.

Figure 17:
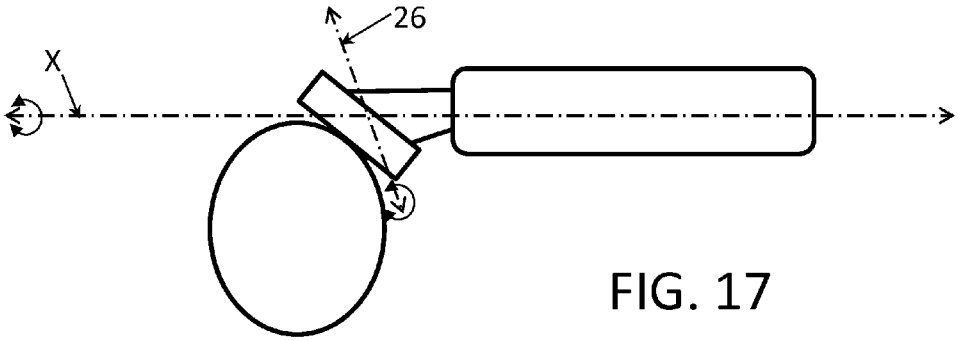

FIG. 17 is a simplified side view of a razor similar to that shown in FIG. 11, in contact with a rotatable support surface.

DETAILED DESCRIPTION OF THE INVENTION

Referring to FIG. 1, a perspective view of a first shaving razor 10 is shown. The first shaving razor 10 may include a handle 12 having a blade cartridge unit 14 with one or more blades 16 for shaving hair. The blade cartridge unit 14 may be mounted to an end of the handle 12. In certain embodiments, the blade cartridge unit 14 may be detached from the handle 12 and replaced. The handle 12 may include a frame 22 and a blade cartridge connecting assembly 24 operably coupled thereto such that the blade cartridge connecting assembly 24 is configured to rotate about a first axis of rotation 26 that is substantially perpendicular to the blades 16 and substantially perpendicular to the handle 12. The blade cartridge unit 14 may also be configured to rotate about a second axis of rotation 34 that is substantially parallel to the blades 16 and substantially perpendicular to the handle 12. Nonlimiting examples of suitable a blade cartridge unit are described in U.S. Pat. No. 7,168,173. When the a blade cartridge unit 14 is attached to the handle 12 via the blade cartridge connecting assembly 24, the blade cartridge unit 14 is configured to rotate about multiple axes of rotation, for example, the first axis of rotation 26 and the second axis of rotation 34.

Figure 2:
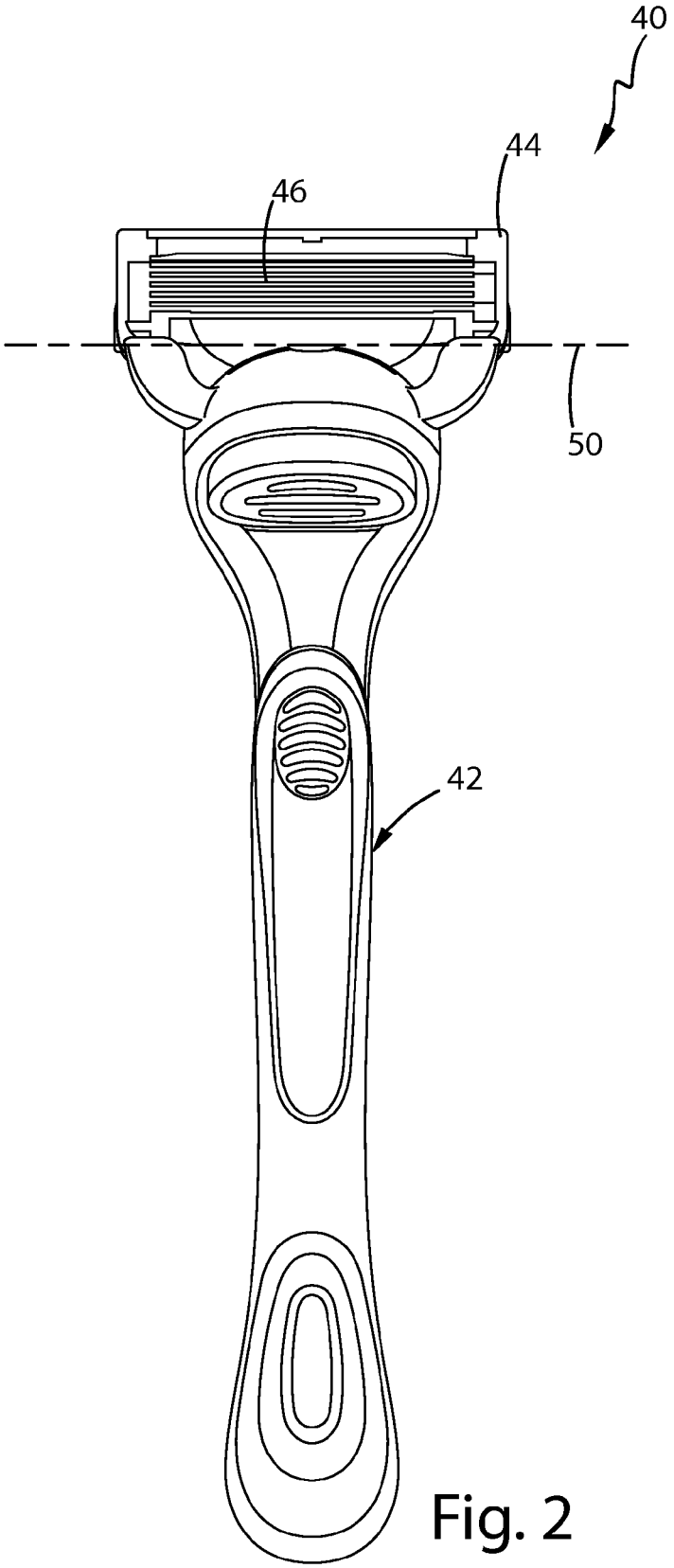
FIG. 2 is a perspective view of a shaving razor with a blade cartridge unit that rotates about one axis of rotation.

The second shaving razor 40 shown in FIG. 2 may be similar to the first shaving razor 10 or may be any other shaving razor described herein. For example, the second shaving razor 40 may include a handle 42 having a blade cartridge unit 44 with one or more blades 46 for shaving hair. The blade cartridge unit 44 may be mounted to an end of the handle 42. In certain embodiments, the blade cartridge unit 44 may be detached from the handle 42 and replaced. The blade cartridge unit 44 may be configured to rotate about a single axis of rotation 50 that is substantially parallel to the blades 46 and substantially perpendicular to the handle 42.

During a shaving stroke it is important for the shaving cartridge unit (e.g., the blades) of the shaving razor to maintain good contact with the surface of the skin. The various contours of an individual's face or body can make it difficult for the shaving cartridge unit to maintain proper contact, which may result in an increase in missed hairs and decreased closeness (e.g., hairs are cut further away from the surface of the skin, resulting in stubble). Therefore, it may be desirable to provide shaving razors that are able to better follow the contours of the face and body and maintain more consistent contact with the surface of the skin during a shaving stroke. Shaving manufacturers have developed single pivot and multi pivot razors, such as the shaving razors 10 and 40 of FIGS. 1 and 2, to better address this problem. The ability of a shaving cartridge to pivot about more than one axis may have improved shaving performance compared to fixed shaving cartridge units (i.e., do not pivot/rotate relative to the handle of the shaving razor) or other shaving cartridges units that pivot only about one axis. In addition, shaving razors having similar axes of rotation may perform differently depending on the force required to rotate the blade cartridge unit. Accordingly, it is important to demonstrate differences in shaving performance of shaving razors that have cartridges that rotate about one or more axes.

Figure 3:
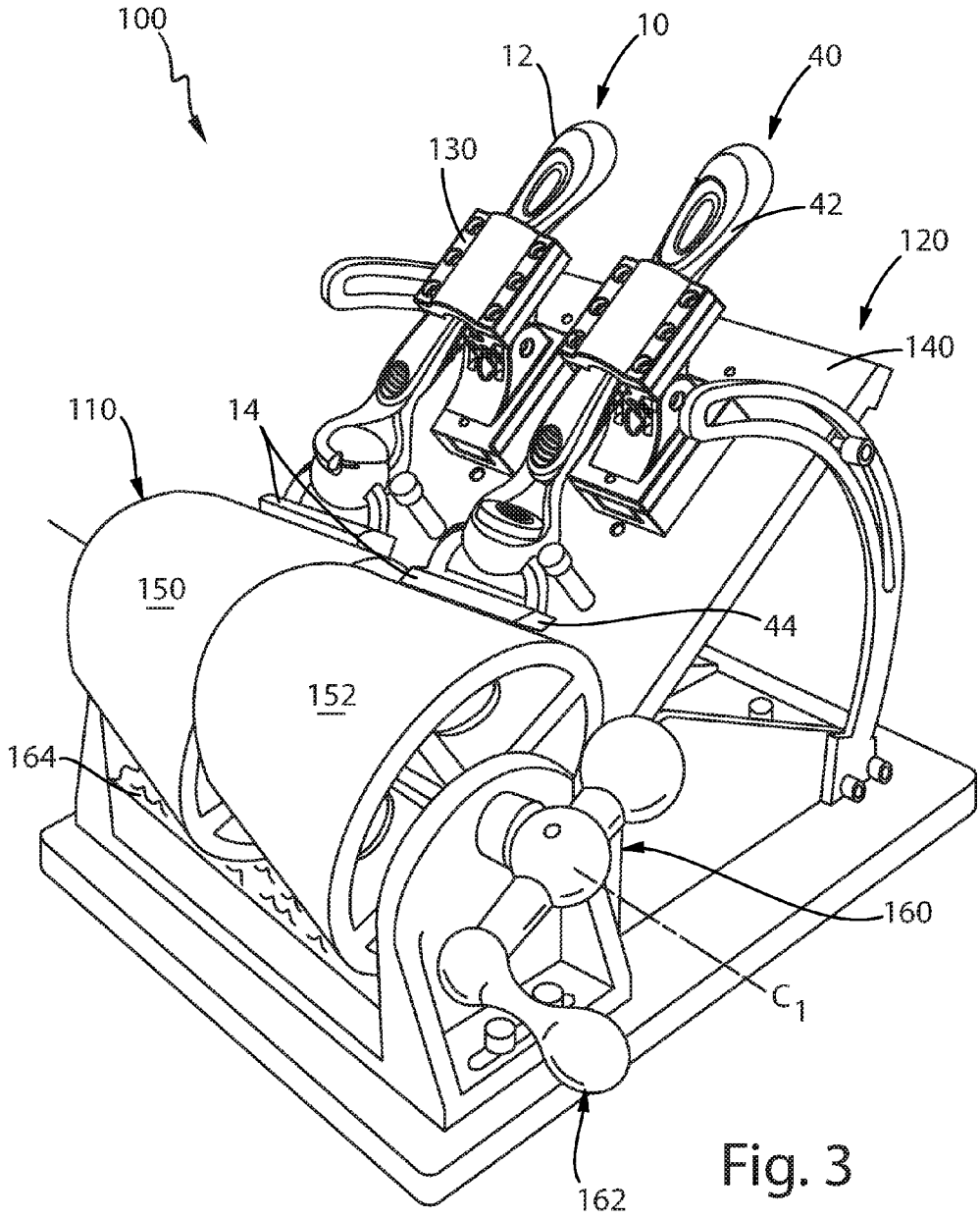
FIG. 3 is a perspective view of one possible embodiment of a shaving demonstration apparatus with the shaving razors of FIGS. 1 and 2.

Referring to FIG. 3, one possible embodiment of the present disclosure is shown illustrating a perspective view of a shaving demonstration apparatus 100. FIG. 3 illustrates the shaving razor 10 and the shaving razor 40 mounted to the shaving demonstration apparatus 100. However, it is understood that any other shaving razor may also be used. Contact between the blade cartridge units 14 and 44 and the rotatable support surface 110 represents contact between the blade cartridge units 14 and 44 and a consumer's skin during a shaving stroke. Improved contact between the razor and the surface of the skin may result in more efficient shaving of hair during a shaving stroke. Improper contact with the skin may result in increased missed hairs and/or an increase in nicks and cuts. The shaving demonstration apparatus 100 may illustrate potential skin contact differences between blade cartridge units. For example, the shaving demonstration apparatus 100 may illustrate to consumers potential shaving performance differences between shaving razors having blade cartridge units that do not rotate about an axis, blade cartridge units that rotate about only a single axis and blade cartridge units that rotate about multiple axes. It is understood that the shaving demonstration apparatus 100 may be used to compare multiple shaving razors, such as the shaving razors 10 and 40 or the shaving demonstration apparatus 100 may be used to demonstrate the performance of a single shaving razor.

The shaving demonstration apparatus 100 may include a rotatable support surface 110 and a fixture 120 for mounting at least one of the shaving razor handles 12 and 42 at a predetermined position relative to the rotatable support surface 110. The fixture 120 may comprise a linear slide 130 mounted directly or indirectly to a platform 140. At least one of the handles 12 and 42 may be mounted and secured in at least one direction to the linear slide 130. The blade cartridge units 14 and 44 may contact the rotating support surface 110, either directly or indirectly. For example, material may be placed between the rotating support surface 110 and the blade cartridge units 14 and 44 to facilitate the movement of the blade cartridge units 14 and 44 against the rotating support surface 110. As will be explained in greater detail below, the linear slide 130 may allow the shaving razors 10 and 40 to move (e.g., slide) between a first and second position relative to the platform 140. The rotatable support surface 110 may rotate about a center axis C1 that is generally parallel to the blades 16 and 46 (not shown) and transverse to the razor handles 12 and 42. In certain embodiments, the rotatable support surface 110 may comprise at least one drum 150 that is rotated by a drive unit 160. Although a second drum 152 is shown, it is understood a single drum may be used to test multiple razors. The drums 150 and 152 may be spaced apart or joined together to form either a continuous surface or a discontinuous surface (as shown). The drive unit 160 may comprise an electrical driven motor or simply a handle 162, as shown. It is understood the rotatable support surface may alternatively comprise a rotating belt (not shown).

In certain embodiments, shaving demonstration apparatus 10 may include a dispenser 164 (e.g., a tray) that deposits a tracking agent and/or lubricant to the rotatable support surface 110 (e.g., the drums 150 and 152). Most shaving razors have an elastomeric guard (not shown) positioned in front of the blades to grip and stretch the skin for an improved shave. The guard may not glide smoothly along the rotatable support surface 110. Accordingly, a lubricant may be applied to the rotatable support surface 110 before and/or during the demonstration. For example, the lubricant may include oil or a shaving preparation, such as a foam or a gel to reduce friction between the blade cartridge units 14 and 44 and the rotatable support surface 110. The tracking agent/lubricant need not be a liquid, but may comprise a solid material, such as a powder that decreases friction between the blade cartridge units 14 and 44 and the rotatable support surface 110. In certain embodiments, the lubricant may also be a tracking agent (e.g., an opaque gel, foam or liquid) that is removed during the demonstration. The tracking agent and/or lubricant may not only facilitate the shaving razors 10 and 40 gliding smoothly during the demonstration (i.e., rotation of the drums 150 and 152), but may further demonstrate improved contact between the blade cartridge units 14 and 44 and the rotatable support surface 110. For example, as the drums 150 and 152 rotate, the blade cartridge units 14 and 44 may remove the tracking agent and/or lubricant from the respective drum 150, 152. A blade cartridge unit that has better contact with the rotatable support surface 110 will remove more of the tracking agent and/or lubricant. Accordingly, during the demonstration the consumer can readily determine which razor provides better contact based on the amount of tracking agent and/or lubricant is removed.

Figure 4:
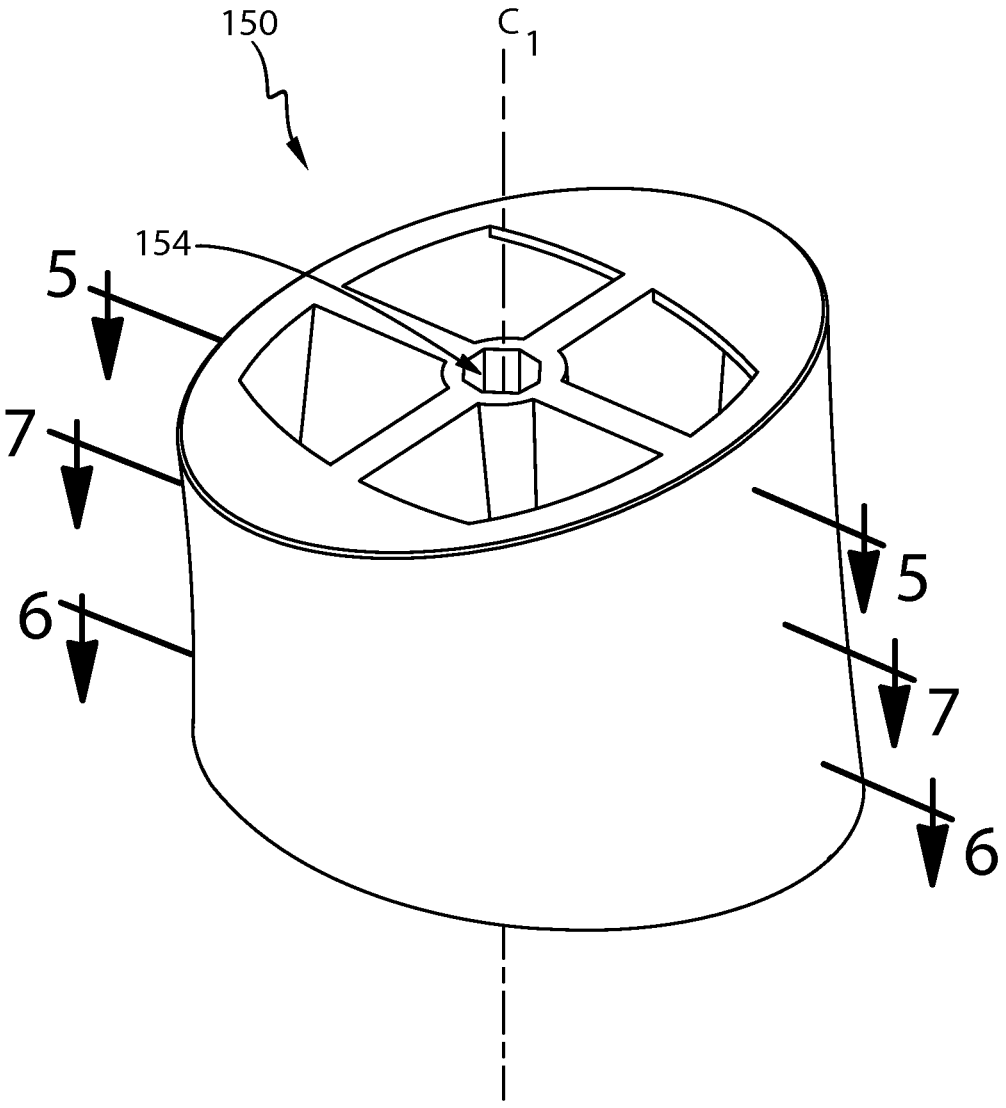
FIG. 4 is a perspective view of a drum which may be incorporated into the shaving demonstration apparatus of FIG. 3.

Referring to FIG. 4, a perspective view of the drum 150 is shown. The drum 150 may define an aperture 154 that extends through the drum 150 along the center axis C1. The aperture 154 may be dimensioned to receive an axle (not shown) of the drive unit 160 of FIG. 3. The drum 150 may be machined or molded out of plastic or metallic material. A material having a low coefficient of friction may be desirable to facilitate the movement of the blade cartridge units 14 and 14 against the rotatable support surface 110 (e.g., the drum 150). As will be explained in greater detail below, the drum 150 and 152 may have a variable cross section along its center axis C1. A variable cross section may facilitate a blade cartridge unit (e.g., blade cartridge units 14 and 44) to rotate differently compared to a uniform cross section (e.g., a cylinder). The surface of a variable cross section drum also better represents the various contours around the face, chin, neck, knees, ankles, etc.

Figure 5:
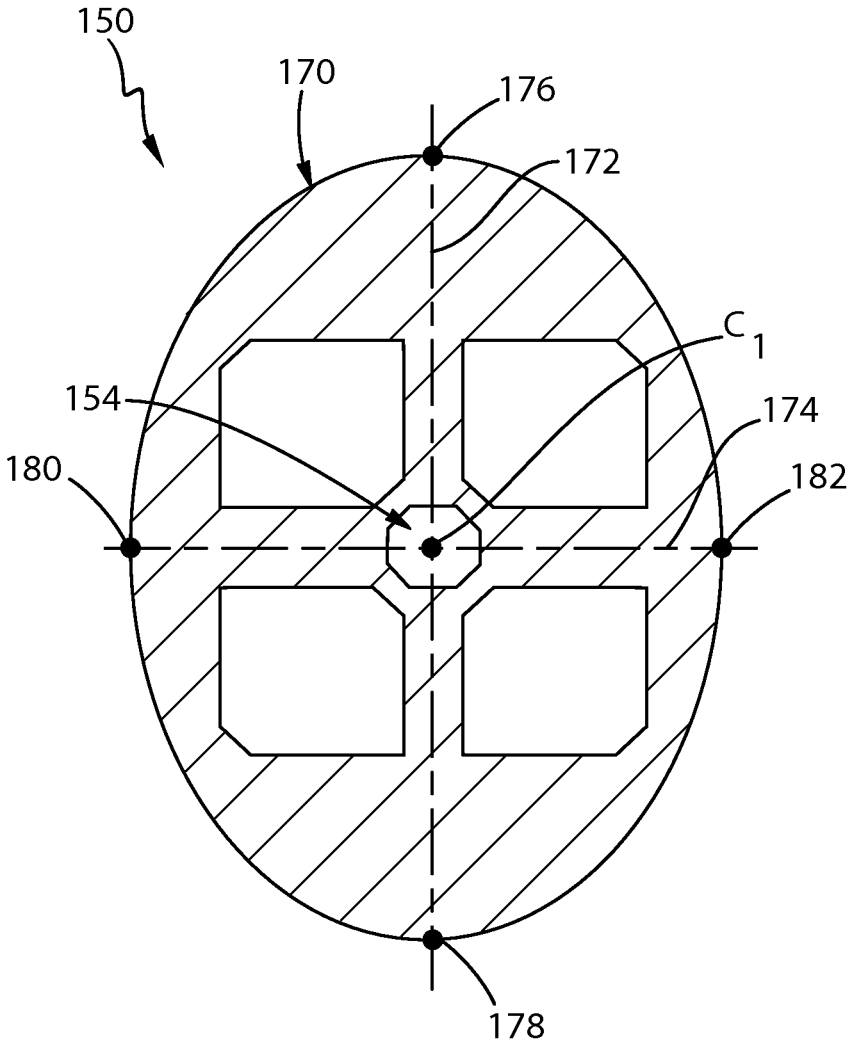
FIG. 5 is a cross section view of the drum, taken generally along the line 5-5 of FIG. 4.

Referring to FIGS. 4 and 5, the drum 150 may have a first cross section taken along the line 5-5 of FIG. 4 that is transverse to the center axis C1 of the drum 150. As shown in FIG. 5, the first cross section may comprise a first ellipse 170. The first ellipse 170 may have a major axis 172 that is longer than a minor axis 174. The major axis 172 of the first ellipse 170 may have a first vertex 176 and a second vertex 178. The minor axis 174 may have a first vertex 180 and a second vertex 182. As will be explained in greater detail below, depending on the shaving razor and/or the blade cartridge unit used, the contact between a specific blade cartridge unit and the drum 150 may vary as the drum 150 rotates. For example, as the drum 150 rotates about the center axis C1 the blade cartridge unit 14 may contact the first vertex 176 of the major axis 172 and may maintain contact with the drum 150 as the blade cartridge unit 14 contacts the first vertex 178 of the minor axis 174, the second vertex 178 of the major axis 172, and the second vertex 180 of the minor axis.

Figure 6:
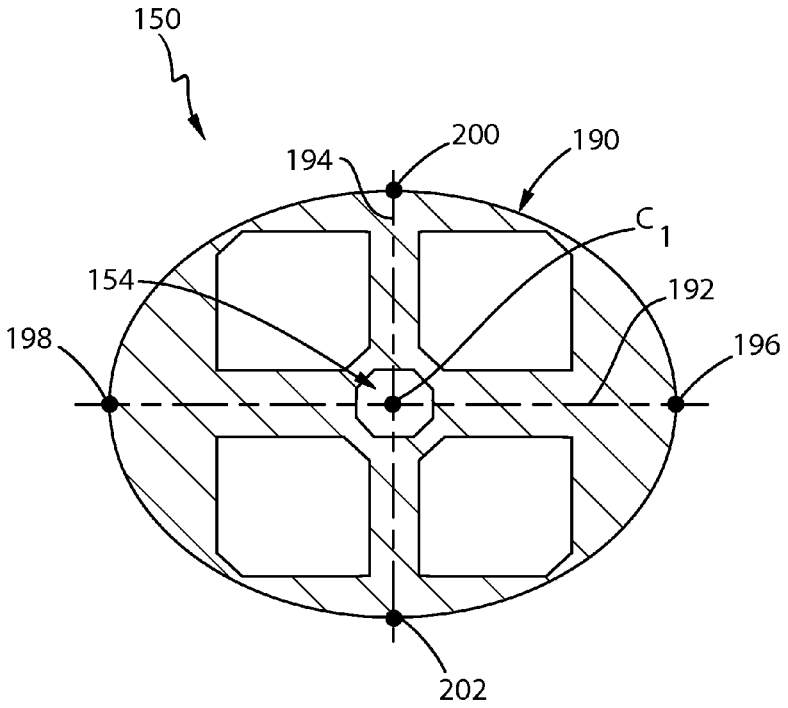
FIG. 6 is a cross section view of the drum, taken generally along the line 7-7 of FIG. 4.

Referring to FIGS. 4 and 6, the drum 150 may have a second cross section taken along the line 6-6 of FIG. 4 that is transverse to the center axis C1 of the drum 150. As shown in FIG. 6, the second cross section may comprise a second ellipse 190. The second ellipse 190 may have a major axis 192 that is longer than a minor axis 194. The major axis 192 of the second ellipse 190 may have a first vertex 196 and a second vertex 198. The minor axis 194 may have a first vertex 200 and a second vertex 202. As will be explained in greater detail below, depending on the shaving razor and/or the blade cartridge unit used, the contact between a specific blade cartridge unit and the drum 150 may vary as the drum 150 rotates. For example, as the drum 150 rotates about the center axis C1 the blade cartridge unit 14 may contact the first vertex 196 of the major axis 192 and may maintain contact with the drum 150 as the blade cartridge unit 14 contacts the first vertex 200 of the minor axis 194, the second vertex 198 of the major axis 192, and the second vertex 202 of the minor axis 194.

Figure 7:
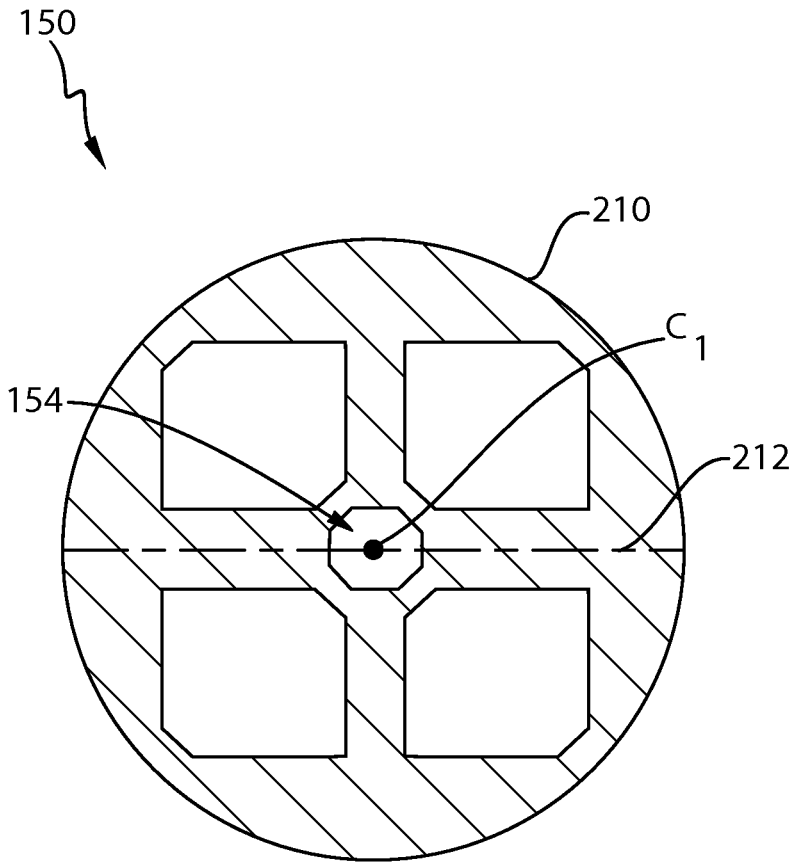
FIG. 7 is a perspective view of another possible embodiment of a shaving demonstration apparatus.

Referring to FIGS. 4 and 7, the drum 150 may have a third cross section taken along the line 7-7 of FIG. 4 that is transverse to the center axis C1 of the drum 150 and between the first and second cross sections. As shown in FIG. 7, the third cross section may be generally circular. For example, the third cross section may comprise a circle 210 having a diameter 212. In certain embodiments, the diameter 212 of the circle 210 may be less than the major axes 176 and 196 of the first and second ellipses 170 and 190.

Figure 8:
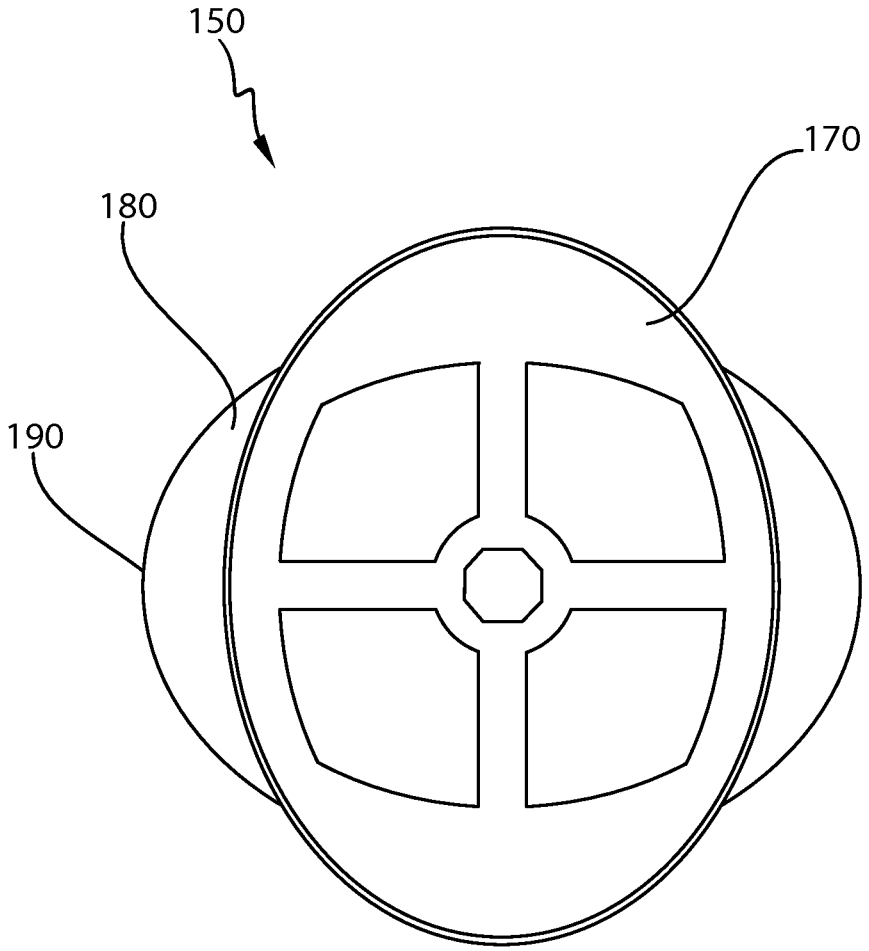
FIG. 8 is an end view of the drum of FIG. 4.

Referring to FIG. 8, a side view of the drum 150 is shown. The first ellipse 170 and the second ellipse 190 may be spaced apart to provide a contoured surface 180 therebetween. In certain embodiments, the first ellipse 170 and the second ellipse 190 may be offset. For example, the first ellipse 170 may be rotationally offset from the second ellipse 190 by about 60 degrees, 70 degrees or 80 degrees to about 90 degrees, 100 degrees, or 110 degrees.

Figure 9A:
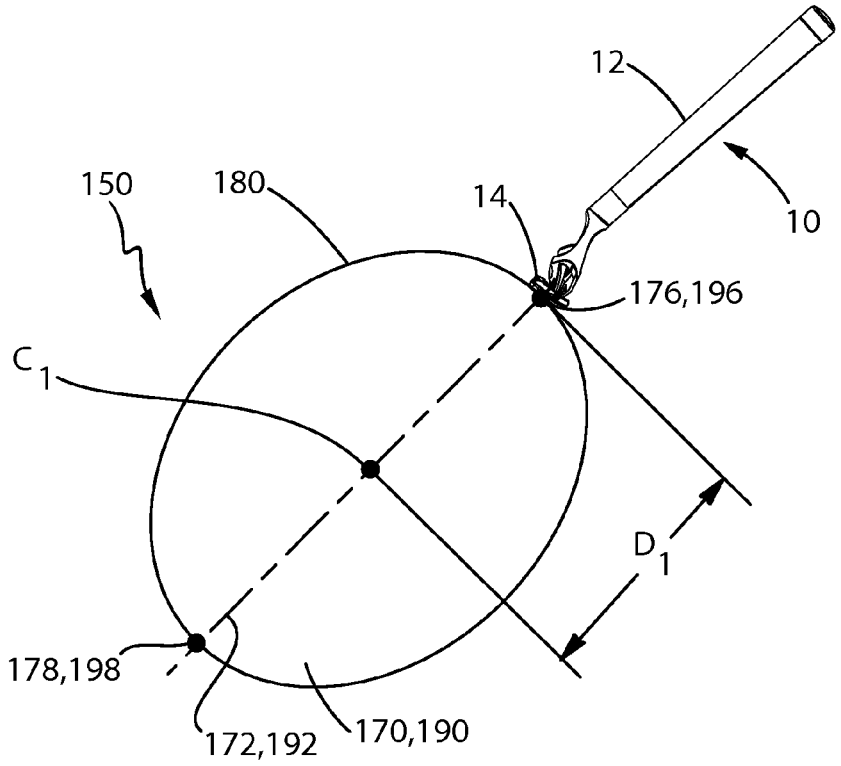
FIGS. 9A and 9B are schematic representations of a first and second position of the shaving demonstration apparatus of FIG. 3.
Figure 9B:
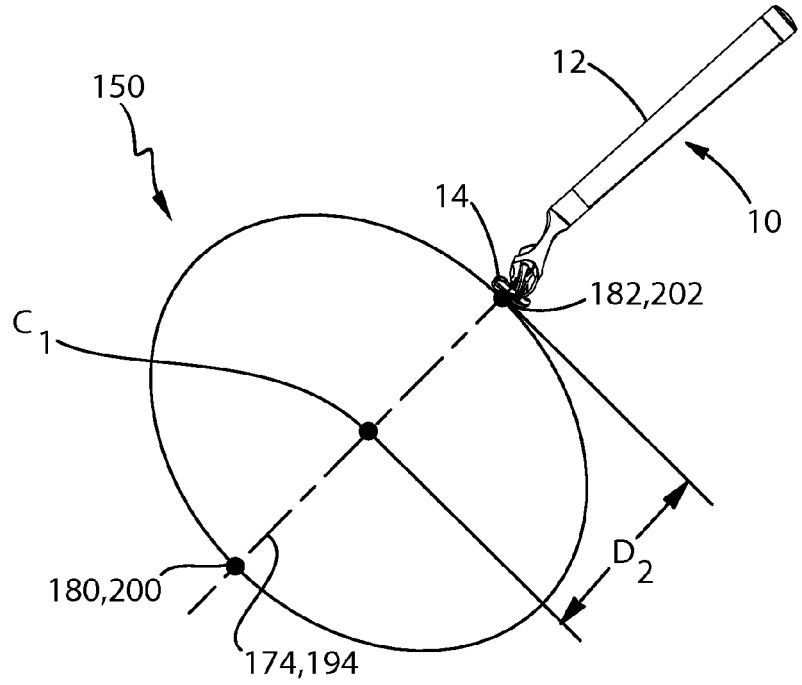

Referring to FIG. 9A, a schematic view of the shaving demonstration apparatus 100 in FIG. 3 is shown illustrating a first position of the first shaving razor 10. The first shaving razor 10 may also have a second position, as illustrated in the schematic view of FIG. 9B. The handle 12 of the first shaving razor 10 may be mounted to the fixture 120, as shown in FIG. 3. The handle 12 may be secured to the linear slide 130. In the first position, the shaving blade unit 14 may contact the first vertex (176 or 196) of the major axis (172 or 192) of the first or second ellipse (170 or 190). Accordingly, the handle 12 may slide relative to the center axis C1 to facilitate contact of the shaving blade unit 14 with the drum 150 (e.g., contoured surface 180) as the drum rotates. In the first position, the blade unit 14 may be spaced apart from the center axis C1 by a first distance D1. The distance D1 may be the same as the distance between the center axis C1 and the vertices 178, 198, 176, 196 of the major axes 172, 192 of the respective first and/or second ellipses 170, 190.

As the shaving razor 10 (e.g., handle 12) slides from the first position to the second position and the blade cartridge unit 14 moves closer to the center axis C1 of the drum 150 (i.e., the blade cartridge unit 150 is closer to the center axis C1 in the second position). In the second position, the blade unit 14 may be spaced apart from the center axis C1 by a second distance D2 that is less than the distance D1. Accordingly, if the handle 12 (or shaving razor 10) did not slide, the blade cartridge unit 14 may not be able to contact the drum 150 (e.g., contoured surface 180) as the drum rotated.

As the rotatable support surface 110 (e.g., drum 150) rotates, the blade cartridge unit 14 of the shaving razor 10 is able to maintain better contact with the rotatable support surface 110 because the blade cartridge unit 14 rotates about more than one axis of rotation. However, the blade cartridge unit 44 of the second razor 40 would only be able to maintain consistent contact with the rotatable support surface 110 if the cross section of rotatable support surface 110 was only circular. Accordingly, the first and second ellipse 170 and 190 that form various cross sections of the drum 150 and the contoured surface 180 between the first and second ellipse 170 and 190 causes the blade cartridge unit 44 of the second razor 40 to engage and disengage the rotatable support surface 110 during rotation of the rotatable support surface 110. It is understood that the blade cartridge unit 44 may not completely disengage the rotatable support surface 110 during rotation of the drum (e.g., a portion of the blade cartridge unit 44 may contact the drum 150 and a portion of the blade cartridge unit may not contact the drum 150). However, the consumer will notice this difference and understand that the blade cartridge unit may not follow the contours of their face and/or body during a shaving stroke as well as a blade cartridge unit that maintains better contact with the drum 150 (e.g., the blade cartridge unit 14 may maintain flush contact with the drum 150 throughout a complete revolution of the drum 150.)

Figure 10:
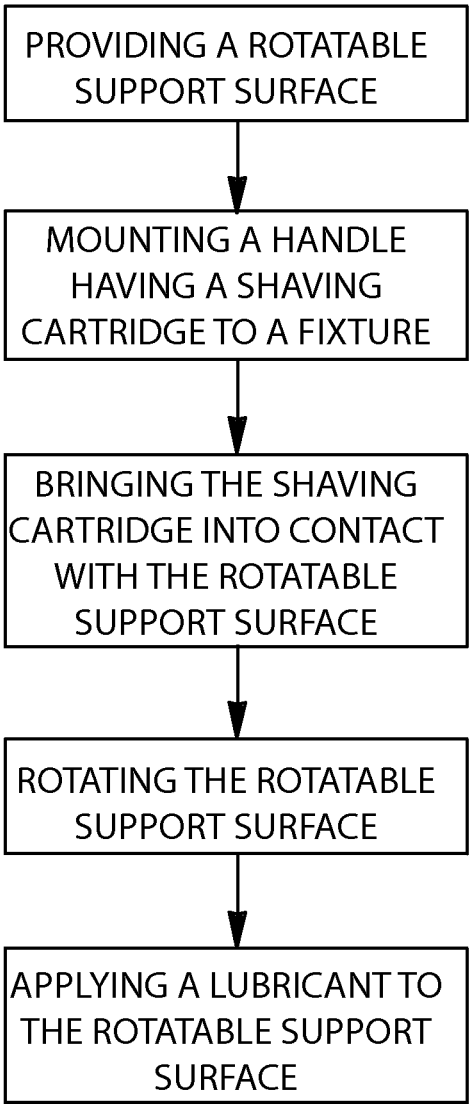
FIG. 10 is a schematic representation of an example of a method for demonstrating shaving razor performance to a consumer.

Referring to FIG. 10, a schematic representation of one possible embodiment of a method for demonstrating shaving razor performance to a consumer is illustrated. The shaving demonstration method may comprise a step of providing a rotatable support surface, such as the rotatable support surface 110 and/or drum 150 as previously described. A handle of a shaving razor, such as the shaving razors 10 and 40 as previously described, may be mounted to a fixture (e.g., the fixture 120 having the linear slide 130). A cartridge that is mounted to the handle may be brought into contact with the rotatable support surface. In certain embodiments, the cartridge may have a pre-load force against the rotatable surface 110. For example, the cartridge may be pressed against the rotatable surface 110 with about 0.05, 0.10, or 0.25 to about 0.5, 1.0, or 2 pounds of force. It is understood that the cartridge need not be brought into direct contact with the rotatable support surface. For example, a piece of felt or other material may be positioned between the rotatable support surface and the cartridge (e.g., either on the cartridge or on the rotatable support surface) to improve the tracking of the cartridge during the demonstration. As previously mentioned, the rotatable support surface may include a rotating belt that contacts the cartridge. The rotatable support surface may be rotated either before the cartridge contacts the rotatable support surface or after the cartridge contact the rotatable support surface. As the rotatable support surface rotates about its center axis C1, the cartridge may rotate about the first axis relative to the handle. In certain embodiments, the rotation of the rotatable support surface about its center axis C1 may cause the cartridge to rotate relative to the handle about two different axes. In certain embodiments, the fixture may comprise a platform and a linear slide that facilitates the handle and/or cartridge to move relative to the platform and/or the rotatable support surface (e.g., the drum 150). A lubricant and/or a tracking agent may be applied at anytime to the rotatable support surface during the demonstration method. The demonstration method may include the tray of lubricant and/or tracking agent as previously described.

FIG. 11 is a frontal perspective view of a razor suitable for use with the present invention in three different orientations. Notably, this type or razor allows the cartridge head to pivot torsionally with respect to the handle, which differs from the pivoting razor shown in FIG. 1. Shaving razors where the razor cartridge can twist with respect to the handle are known. See e.g. US Patent Publication Nos. 2012/0260509, 2012/0246947, 2011/0035950 and 2010/0313426, and U.S. Pat. Nos. 5,560,106, 6,615,498, and WO2011 131945A1.

FIGS. 11 and 12 show three a shaving razor where the cartridge can rotate torsionally in three positions. The first shaving razor having a first handle 1000 comprising a grip portion 1100, a connection portion 1200, and a central longitudinal axis X. The razor includes a first blade cartridge unit 1300 mounted to an end of the first handle such that the connection portion 1200 is intermediate said cartridge unit and said grip portion. The cartridge unit (and optionally the intermediate portion) is rotatable around a torsional rotation axis which is in this case the same as said central longitudinal axis X. In other embodiments, the torsional rotation axis can be generally parallel to the central longitudinal axis, such as shown in US Patent Publication No. 2010/0313426. The view in the middle is of the razor in an at rest position. An optional alignment indicator 1210 is shown to assist the user or viewer to know the relative position of the cartridge unit. As a counter clockwise twisting force is applied to the razor cartridge head, at least the cartridge head, and optionally a portion of the handle to which it attaches 1200, rotates counter clockwise as shown in the image on the left. As a clockwise force is applied to the cartridge head, the cartridge rotates accordingly. FIG. 13 is a frontal planar view of this same razor where the cartridge is shown rotating between the at rest position (in solid lines) and in the clockwise and counterclockwise biased positions (in dashed lines).

FIGS. 14*a* and 14*b* perspective view of one possible embodiment of a shaving demonstration apparatus similar to that shown in FIG. 3, but with the modification that the shaving razors are repositioned such that the face of the razor cartridge head lies onto the rotatable support surface 150, as opposed to forming a line directed that points into the rotatable support surface as shown in FIG. 1. FIG. 14*a* is a frontal elevated view showing the cartridge head rotated in clockwise position due to the position of the rotatable contact surface 150. Also shown in this figure is a second shaving razor which can be a conventional razor which does not have a torsional rotation movement.

FIG. 14*b* shows the top view of the apparatus where the torsional rotation axis X and said center axis C1 are substantially perpendicular. Also shown here is that the rotatable support surface does not form a perfect cone. Rather, the rotatable support surface is a drum, wherein a first cross section of the drum is a first ellipse and wherein a second cross section of the drum is a second ellipse that is offset from the first ellipse. The first and second ellipses shown here are offset by about 90 degrees.

In this embodiment, the first blade cartridge unit is mounted to an end of the first handle and rotatable around a torsional rotation axis which is generally parallel to said central longitudinal axis, wherein the first blade cartridge unit contacts the rotatable support surface. In one embodiment, the blade cartridge unit is positioned relatively above the center axis of the rotatable surface, preferably in the upper ⅓ portion of the drum, such that any force applied onto the cartridge head is generally perpendicular to the torsional rotational axis to bias the cartridge unit to rotate clockwise or counterclockwise with respect to said torsional rotational axis. In one embodiment, the central longitudinal axis and said center axis are non-coplanar, where the central longitudinal axis intersects the drum, it is above the center axis, preferably in the upper ⅓ or ⅕ region of the drum. In one embodiment, the apparatus is such that in a first position said rotatable support surface biases said first blade cartridge about said torsional rotation axis from an at rest position into a first biased position (which is shown here in a counter clockwise position, and shown in FIG. 15*a* in a second, clockwise position).

Also possible would be for the second shaving razor to be similar to the first razor, or the razor shown in FIG. 1. If it is the razor shown in FIG. 1, the razor can be repositioned to move backwards away from the rotatable support surface such that a central longitudinal line drawn in the handle points into the rotatable support surface. This could be a useful embodiment to show how razors similar to that shown in FIG. 1 conform to the shaving surface in contrast to razors similar to those shown in FIG. 11. Also within the scope of the invention would be for multiple additional razors to be included in the apparatus, such as a third razor which could be the conventional razor. Given the positioning of the razor differs depending on the additional axis of rotation, two conventional razors can be included, one having the same positioning as each of the razors similar to that of FIG. 1 and FIG. 11.

FIGS. 15*a* and 15*b* show the same set up as in FIGS. 14*a* and 14*b*, but with the rotatable surface turned 90°.

FIG. 16 is a simplified side view of a razor similar to that shown in FIG. 1, in contact with a rotatable support surface. As shown here, the razor is generally in line with the rotatable support surface such any force applied by the surface would generally be directed into the razor cartridge unit along the central longitudinal axis X. This would create a biasing force which would cause the razor cartridge unit to rotate about axis 34.

FIG. 17 is a simplified side view of a razor similar to that shown in FIG. 11, in contact with a rotatable support surface. As shown in this figure, the razor is generally positioned above, or along the upper portion of the rotatable support surface such any force applied by the surface would generally be directed upwards into the razor cartridge unit, perpendicular to the central longitudinal axis X. This would create a biasing force which would cause the razor cartridge unit to rotate about the torsional rotational axis, in this embodiment shown as being the same as the central longitudinal axis of the razor X. As explained above, the torsional rotational axis can be general parallel to the central longitudinal axis, or it can vary slightly, such as by 30° or otherwise explained herein.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A shaving demonstration apparatus comprising:

a rotatable support surface comprising a center axis;

a drive unit operatively connected to the rotatable support surface;

a fixture spaced apart from the rotatable support surface;

a first shaving razor having a first handle comprising a central longitudinal axis, said first handle mounted to the fixture, wherein said central longitudinal axis is perpendicular to said center axis about which said rotatable support surface rotates;

a first blade cartridge unit comprising at least one blade, said first blade cartridge unit mounted to an end of the first handle and rotatable around a torsional rotation axis which is generally parallel to said central longitudinal axis, wherein the first blade cartridge unit contacts the rotatable support surface, wherein in a first position, said rotatable support surface biases said first blade cartridge unit about said torsional rotation axis from an at rest position into a first biased position, wherein said center axis is generally parallel to said at least one blade, wherein the rotatable support surface is a drum, wherein a first cross section of the drum is a first ellipse.

2. The shaving demonstration apparatus of claim 1, wherein in a second position said rotatable support surface biases said first blade cartridge unit about said torsional rotation axis into a second biased position opposite said first biased position.

3. The shaving demonstration apparatus of claim 1, wherein said torsional rotation axis and said center axis are perpendicular.

4. The shaving demonstration apparatus of claim 1, wherein said first handle comprises a grip portion and a connection portion intermediate said grip portion and said first blade cartridge unit, wherein said connection portion and said first blade cartridge unit rotate with respect to said grip portion about said torsional rotation axis.

5. The shaving demonstration apparatus of claim 1, wherein the first handle moves between a first handle position and a second handle position relative to the center axis of the rotatable support surface.

6. The shaving demonstration apparatus of claim 1 wherein the fixture comprises a platform and a linear slide mounted to the platform.

7. The shaving demonstration apparatus of claim 6, wherein the first handle is fixed to the linear slide and the linear slide moves relative to the platform.

8. The shaving demonstration apparatus of claim 1 wherein a second cross section of the drum is a second ellipse that is offset from the first ellipse.

9. The shaving demonstration apparatus of claim 8, wherein a third cross section of the drum taken between the first and second cross sections is circular.

10. The shaving demonstration apparatus of claim 8, wherein the first and second ellipses are offset by 90 degrees.

11. The shaving demonstration apparatus of claim 10 wherein the first ellipse and the second ellipse are spaced apart with a contoured surface therebetween.

* * * * *